US009761121B2

(12) United States Patent
Parkulo et al.

(10) Patent No.: US 9,761,121 B2
(45) Date of Patent: Sep. 12, 2017

(54) PUMP PANEL ACCOUNTABILITY DEVICE AND METHOD OF USE

(71) Applicant: Scott Technologies, Inc., Boca Raton, FL (US)

(72) Inventors: Craig Michael Parkulo, Midland, NC (US); Thomas G. Riley, Lake Worth, FL (US)

(73) Assignee: Scott Technologies, Inc., Boca Raton, FL (US)

( * ) Notice: Subject to any disclaimer, the term of this patent is extended or adjusted under 35 U.S.C. 154(b) by 105 days.

(21) Appl. No.: 14/951,846

(22) Filed: Nov. 25, 2015

(65) Prior Publication Data

US 2016/0078749 A1 Mar. 17, 2016

Related U.S. Application Data

(63) Continuation of application No. PCT/US2014/039959, filed on May 29, 2014.

(60) Provisional application No. 61/828,898, filed on May 30, 2013.

(51) Int. Cl.

| | |
|---|---|
| ***G08B 3/00*** | (2006.01) |
| ***G08B 27/00*** | (2006.01) |
| ***A62C 27/00*** | (2006.01) |
| ***A62C 37/50*** | (2006.01) |
| *G08B 21/18* | (2006.01) |

(52) U.S. Cl.

CPC ..... *G08B 27/001* (2013.01); *A62C 27/00* (2013.01); *A62C 37/50* (2013.01); *G08B 21/187* (2013.01)

(58) Field of Classification Search

CPC ..... A62C 27/00; A62C 37/50; G08B 21/187; G08B 27/001

USPC ..... 340/539.13, 573.1, 691.6

See application file for complete search history.

(56) References Cited

U.S. PATENT DOCUMENTS

| | | | | |
|---|---|---|---|---|
| 5,577,496 | A * | 11/1996 | Blackwood | A62B 18/006 128/201.25 |
| 6,186,140 | B1 * | 2/2001 | Hoague | B01D 29/60 128/201.25 |
| 6,473,004 | B1 * | 10/2002 | Smull | B63B 17/06 114/183 R |
| 2005/0146432 | A1 * | 7/2005 | Perez Garcia | A62C 99/00 340/539.13 |
| 2009/0260836 | A1 * | 10/2009 | Laskaris | A62C 5/02 169/24 |
| 2012/0055815 | A1 * | 3/2012 | Truex | A62B 9/006 206/205 |
| 2013/0112195 | A1 * | 5/2013 | Smith | G02B 27/017 128/202.13 |

(Continued)

*Primary Examiner* — Ojiako Nwugo

(74) *Attorney, Agent, or Firm* — Christopher & Weisberg, P.A.

(57) ABSTRACT

A system and method of use for an accountability system within a pump panel for signaling an alarm condition to first responders. The method and system include a display embedded within a pump panel, and a radio frequency (RF) sub-system. The RF sub-system is configured to receive transmissions from a respiratory protection device (RPD). The RPD is configured to transmit an alarm condition. The method and system also include a controller coupled to the display and the RF sub-system. The controller is configured to instruct the display to display an accountability indicator once the alarm condition is received by the RF sub-system.

20 Claims, 6 Drawing Sheets

(56) References Cited

U.S. PATENT DOCUMENTS

| | | | | |
|---|---|---|---|---|
| 2013/0152919 | A1* | 6/2013 | Billingsley | A62B 7/10<br>128/201.25 |
| 2013/0152920 | A1* | 6/2013 | Billingsley | A62B 7/10<br>128/201.25 |
| 2014/0060542 | A1* | 3/2014 | Volmer | A62B 18/006<br>128/205.23 |
| 2014/0190483 | A1* | 7/2014 | Hansen | A62B 7/02<br>128/205.12 |
| 2015/0283409 | A1* | 10/2015 | Buck | A62B 7/02<br>128/204.22 |

* cited by examiner

PUMP PANEL ACCOUNTABILITY DEVICE AND METHOD OF USE

RELATED APPLICATION DATA

This application is a continuation of International PCT Application No. PCT/US2014/039959 filed May 29, 2014, which claims priority to and the benefit of the filing date of U.S. Provisional Application No. 61/828,898, filed on May 30, 2013, the contents of each of which is incorporated herein by reference.

BACKGROUND OF THE INVENTION

The subject matter disclosed herein relates generally to accountability detection and response devices for first responders.

Emergency personnel systems for first responders (e.g., firefighters) include location/tracking, electronics and sensor monitoring indoors/outdoors to aid in emergencies. For example, first responders (e.g., firefighters, rescue workers, emergency service personnel, HazMat teams, or the like) have begun carrying a variety of respiratory protection device (e.g., GPS, distress signal unit, automatic distress signal unit, position monitors, personal alarm safety system ("PASS"), or the like) on backpacks or a headgear. The respiratory protection device alerts other first responders when the wearer is in distress by transmitting an alarm condition.

During emergencies, an incident commander or another first responder may be in contact and continually monitor the condition of first responders on the scene using, for example, accountability networks. Accountability networks are used by first responders to provide and/or receive command and control instructions such as, for example, evacuation commands, from an on-scene commander during emergency situations. Traditionally, a first responder and/or on-scene commander would monitor the accountability network using stand-alone equipment requiring set up time to establish the network, which may delay emergency services.

Emergency service vehicles (e.g., fire trucks, HazMat vehicles) have begun to include communication systems within a vehicle control system to establish communication networks, as disclosed in, for example, U.S. Pat. Nos. 6,909,944 and 7,184,866 all of which is expressly incorporated by reference in their entirety. However, these references and conventional emergency service vehicles do not provide accountability information or operate as a command and control site through the accountability network. Thus, there is a need to integrate the accountability system to emergency service vehicles.

SUMMARY OF THE PRESENT INVENTION

In accordance with embodiments herein, a system is provided for an accountability system for signaling an alarm condition to first responders. The system includes a display embedded within a pump panel, and a radio frequency (RF) sub-system. The panel includes at least one gauge and at least one valve indicator. The RF sub-system is configured to receive transmissions from a respiratory protection device (RPD). The transmissions including an alarm condition. The system also includes a controller coupled to the display and the RF sub-system. The controller is configured to instruct the display to display an accountability indicator once the alarm condition is received by the RF sub-system.

Optionally, the RF sub-system of the accountability system may further be configured to transmit data to the RPD. Alternatively, the RF sub-system may transmit at least one of an acknowledgement signal or alert signal in response to the alarm condition Optionally, the pump panel of the accountability system may further include a power activation mechanism for selectively supplying power to the pump panel control, the power activation mechanism having at least a power on condition and power off condition. Alternatively, the pump panel is affixed to a platform. Optionally, the pump panel is on a portion of an exterior of a fire truck.

Optionally, the alarm condition of the accountability system is due to at least one of a group consisting of a low air pressure, a PAR check activation, an evacuate alarm, a low air alarm, a man down alarm, a respiratory failure, or a low blood pressure.

Optionally, the accountability system may have one or more gauges of the pump panel displayed on the display.

Optionally, the accountability indicator on the display of the accountability system are selected from a group consisting of a flashing indicator or pop-up window.

Optionally, the controller of the accountability system is further configured to instruct a speaker of the pump panel to transmit an audio signal with the accountability indicator.

Optionally, the display of the accountability system is a touch sensitive display screen.

In accordance with embodiments herein, a method for signaling an alarm condition to first responders from a pump panel is provided. The method includes supplying power to a pump panel once a power activation mechanism is in a power on condition. The method includes receiving an alarm condition from a respiratory protection device (RPD) of a first responder. The alarm condition includes identification data corresponding to the RPD. The method also includes identifying the alarm condition, and displaying an accountability indicator with the identification data on a display that corresponds to the alarm condition once the alarm condition is identified. The display is embedded within the pump panel of an emergency service vehicle.

Optionally, the emergency service vehicle of the method may be a fire truck.

Optionally, the identifying operation of the alarm condition in the method may further identify that the alarm condition is due to at least one of a group consisting of a low air pressure, a PAR check activation, an evacuate alarm, a low air alarm, a man down alarm, a respiratory failure, or a low blood pressure.

Optionally, the method may further comprise displaying a gauge in a graphical manner that corresponds to a water pressure of a valve on the pump panel. Alternatively, the method may further comprise emitting an audio alert from a speaker on the pump panel. Optionally, the method may further comprise transmitting at least one of an acknowledgement signal or alert signal in response to the alarm condition.

Optionally, the pump panel of the method may be affixed to a platform.

Optionally, the accountability indicator on the display of the method is at least one of from a group consisting of a flashing indicator or pop-up window.

In accordance with embodiments herein, a pump panel for an emergency service vehicle is provided. The pump panel includes a platform affixed to an emergency service vehicle, and a power activation mechanism configured to supply power when in a power on condition. The pump panel further includes one or more gauges. The gauges measure a water pressure to a corresponding valve. The pump panel includes a display, and an RF-subsystem configured to receive a transmissions from a respiratory protection device (RPD). The transmission includes an alarm condition. And the pump panel includes a controller configured to identify when an alarm condition is received by the RF sub-system, the controller instructs the display to display an accountability indicator when the alarm condition is identified.

DETAILED DESCRIPTION OF THE DISCLOSURE

The foregoing summary, as well as the following detailed description of certain embodiments will be better understood when read in conjunction with the appended drawings. As used herein, an element or step recited in the singular and proceeded with the word "a" or "an" should be understood as not excluding plural of the elements or steps, unless such exclusion is explicitly stated. Further, references to "one embodiment" or "an exemplary embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional elements not having that property.

Figure 1:
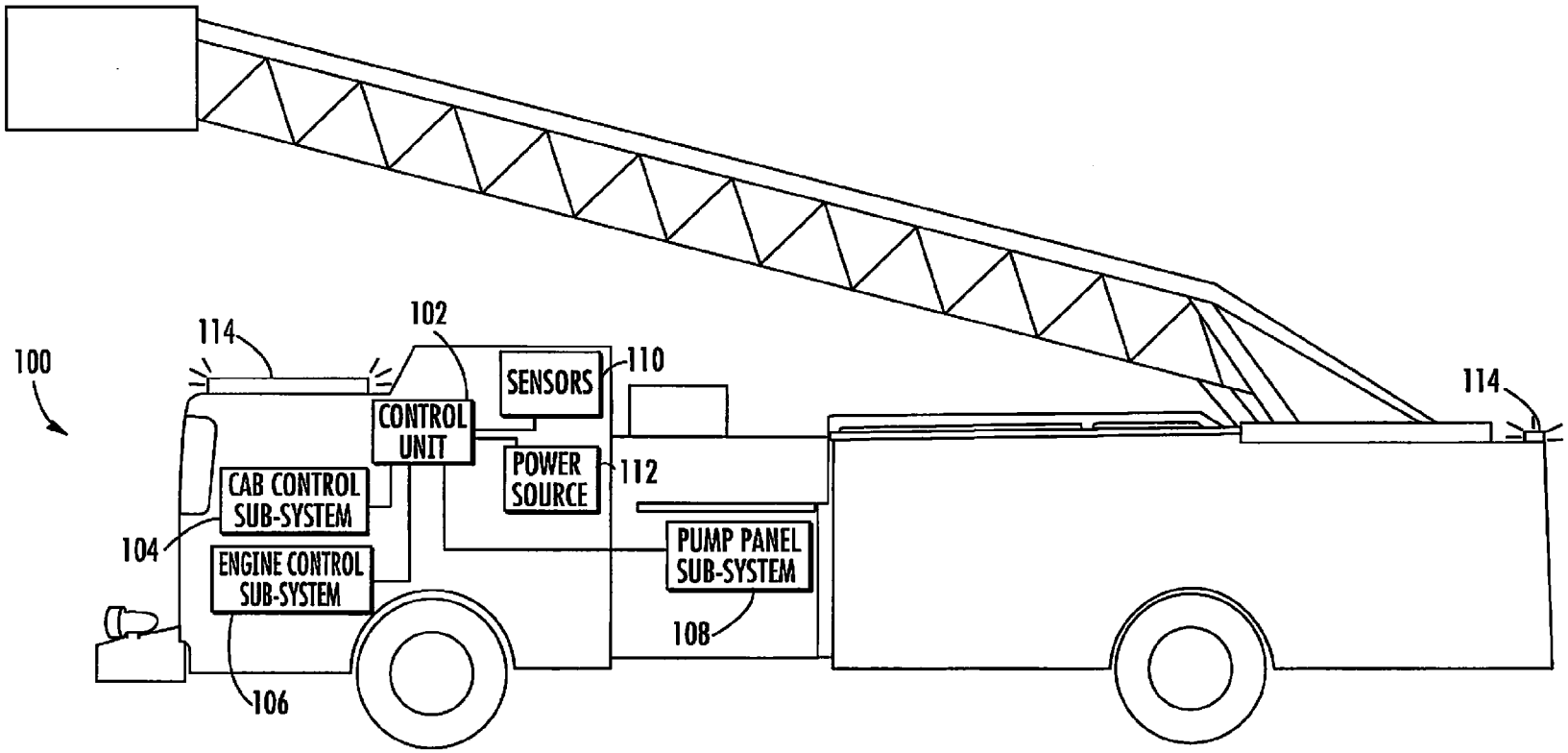
FIG. 1 illustrates simplified block diagram of an emergency service vehicle, in accordance with an embodiment herein.

FIG. 1 illustrates an emergency service vehicle (ESV) 100, for example, a fire truck, Hazardous Material (HazMat) vehicle, or the like. The ESV 100 may include a control unit 102 and a plurality of sub-systems, such as, a cab control sub-system 104, an engine control sub-system 106, a pump panel sub-system 108, and the like. The ESV 100 may also include a plurality of sensors 110 (e.g., fluid level sensors, environmental sensors, pressure sensors, or the like) that are operatively coupled to the control unit 102 and/or one or more sub-systems 104-108 of the ESV 100. The control unit 102 may be a microprocessor-based device and include one or more processors configured to control the various sub-systems 104-108 of the ESV 100. The control unit 102 may control power distribution of a power source 112 within the ESV 100 to provide power to one or more sub-systems 104-108 through a power line routed throughout the ESV 100 and electrically coupled to the various sub-systems 104-108 and components of the ESV 100. Optionally, the control unit 102 may direct, monitor, and/or establish communication links between the sub-systems 104-108. For example, the control unit 102 may establish a communication link between the cab control sub-system 104 and the engine control sub-system, which may interface with the braking system, engine, or the like.

Each of the sub-systems 104-108 may be operatively coupled to various I/O devices (e.g., user interface 304, a display 306, or the like) to control various components of the ESV 100. For example, the cab control sub-system 104 may receive inputs from switches that control an emergency lighting system 1114 of the ESV 100.

Figure 2:
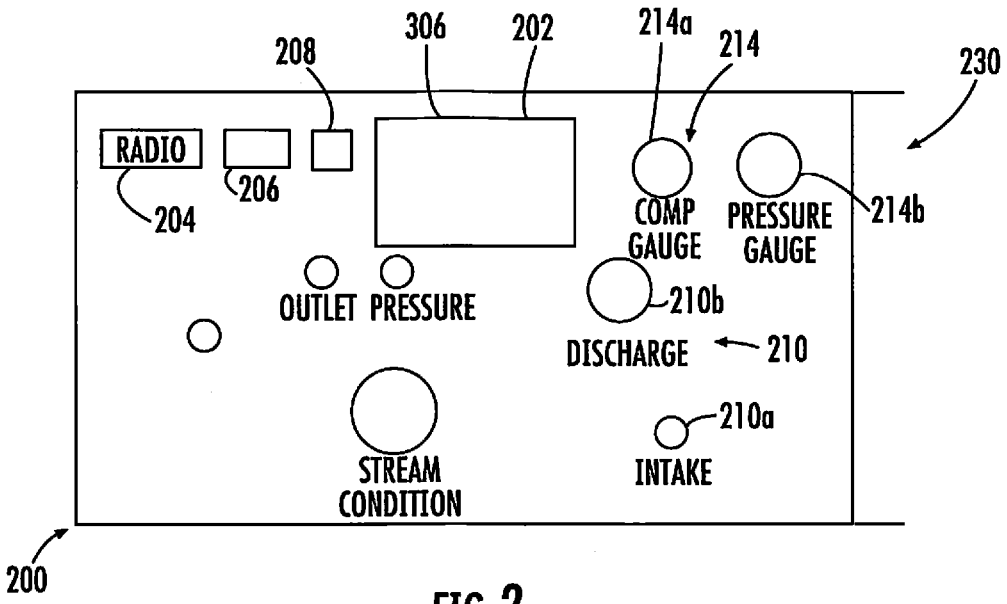
FIG. 2 illustrates a perspective view of a pump panel, in accordance with an embodiment herein.

FIG. 2 illustrates a perspective view of a pump panel 200 controlled by the pump panel sub-system 108. The pump panel 200 may be positioned on the rear, or right/left lateral exterior of the ESV 100. Optionally, the pump panel 200 may be integrated into a structural frame of the ESV 100. Additionally or alternatively, the pump panel 200 may be affixed to a platform 230. The platform 230 may be configured to be movable and supported within or on the ESV 100. Additionally or alternatively, the pump panel 200 or a portion thereof may be a digital representation of controls and/or gauges 214 presented in a graphical manner on the display 306.

The pump panel 200 includes one or more gauges 214, such as, a compound gauge 214*a* and a pressure gauge 214*b*. The pump panel 200 also includes one or more valve indicators 210. The gauges 214 or indicators may include an analogue instrument meter (e.g., needle gauge) and/or digital instrument meter displaying water pressure, foam pressure, fluid level (e.g., fuel level, coolant level, water level, oil level), or the like of the valve indicators 210. The valve indicators 210 may regulate (e.g., pressure), direct, and/or control the flow of liquids (e.g., water) entering (e.g., intake valve indicator 210*a*) or leaving (e.g., discharge valve indicator 210*b*) the ESV 100. For example, the compound gauge 214*a* measures pressure from the intake valve indicator 210*a*, and the pressure gauge 214*b* measures pressure from the discharge valve indicator 210*b*. Optionally, one or more of the gauges 214 may be displayed on the display 306 in a graphical manner shown digitally (e.g., as a numerical value) or shown as an analogue gauge.

The pump panel 200 may also include a radio 204 and a speaker 206 electrically coupled to the radio 204. The radio 204 may receive voice transmissions from first responders (e.g., proximate to the ESV or emergency location), other ESV 100, different locations within the ESV 100 (e.g., from the Cab), dispatch centers, or the like. The speaker 206 may broadcast the voice transmission received by the radio 204.

The pump panel 200 may also include a power activation mechanism 208. The power activation mechanism 208 is configured to selectively activate or power the pump panel sub-system 108 by directing power (e.g., electrical current, electrical voltage) from the power source 112 to the pump panel sub-system 108 and its components (e.g., the radio 204, pump panel accountability device 202, the platform 230). Optionally, the power activation mechanism 208 may instruct the control unit 102 to distribute power from the power source 112 to the pump panel sub-system 108. For example, a first responder engages or switches the power activation mechanism 208 to an 'ON' position. The control unit 102 may direct power from the power source 112 to the pump panel sub-system 108 to correspond to the power condition (e.g., power on condition) of the power activation mechanism 208. Once the first responder disengages or switches the power activation mechanism 208 to an 'OFF' position. The control unit 102 may disconnect or stop the pump panel sub-system 108 from receiving power from the power source 112 to correspond to the power condition (e.g., power off condition) of the power activation mechanism 208.

The pump panel 200 includes an accountability device 202 coupled to a display 306 that is embedded within the pump panel 200 to allow first responders adjacent to the pump panel 200 to view information displayed on the display 306. The accountability device 202 is configured to signal an alarm condition for first responders. An alarm condition may represent a life threatening situation or alert from a first responder. The alarm condition may be initiated due to one of low air pressure, a low air state, a man down alarm, personal accountability report (PAR) check activation, evacuation, biometrics, combination thereof, or the like.

Figure 3:
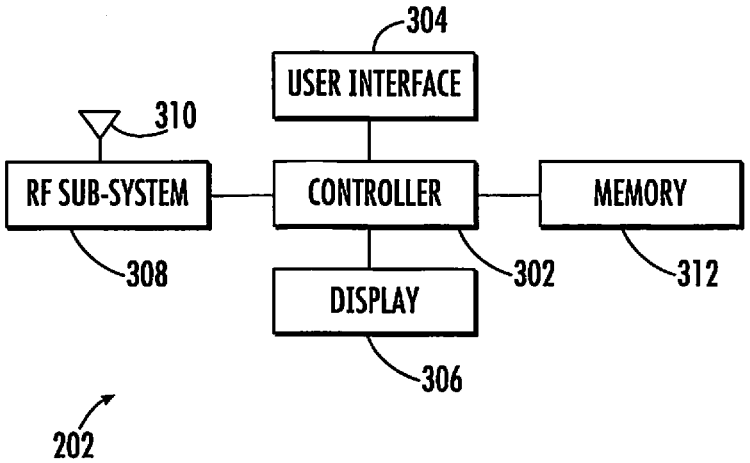
FIG. 3 illustrates a simplified block diagram of an accountability device, in accordance with an embodiment herein

FIG. 3 illustrates a simplified block diagram of the accountability device 202. The accountability device 202 includes a controller 302 coupled to a user interface 304, a display 306, memory 312, a radio frequency (RF) sub-system 308, and the like. The controller 302 may include one or more processors to implement various accountability indicators once an alarm condition is received by the RF sub-system 308 to the display 306 (e.g., flashing alerts), the speaker 206 (e.g., siren, voice alert, ringing), through a tactile applicator (e.g., vibrations, rubbing), or the like to alert or bring attention to the pump panel 200, or specifically, the accountability device 202. The memory 210 may include cache, Flash, RAM, ROM, or one or more different types of memory used for temporarily storing data. The memory 210 may be used to store firmware, software, image data, non-image data, status information, an identification database, wireless protocol/syntax, or the like. For example, memory 210 may be provided for storing firmware for system applications (e.g., operating system, user interface functions which may include a graphical user interface, wireless protocols, or the like).

The RF sub-system 308 is coupled to an antenna 310 and provides wireless reception and/or transmission over one or more networks. The RF sub-system 308 provides a wireless interface or communication link with one or more respiratory protection device (e.g., self-contained breathing apparatus (SCBA), Compressed Air Breathing Apparatus, Industrial breathing sets, Air-pack, or the like) 400. For example, the RF sub-system 308 is configured to receive an alarm condition transmitted from the respiratory protection device 400. The wireless interface allows the RF sub-system 308 to receive wireless data from the respiratory protection device 400. Optionally, the wireless interface allows the RF sub-system 308 to transmit wireless data to the respiratory protection device 400 or other ESVs. For example, the RF sub-system 308 may transmit an acknowledgement signal to the respiratory protection device 400 and/or retransmit the alarm condition to other respiratory protection devices 400. The RF sub-system 308 may utilize various wireless communication protocols such as WiFi, Bluetooth classic, Bluetooth Low Energy (BLE), WiGig, Wireless HD, Z-Wave, Zigbee, 802.11 and the like.

The user interface 304 provides an interface that allows a user (e.g., first responder) to interact with the accountability device 202. The user interface 304 may receive user inputs (e.g., from first responders or incident commanders) and provide the user inputs to the controller 302. The user interface 304 may include a touch-sensitive interface overlaid or integrated with the display 306, such as, a touch-sensitive display screen (e.g., touch screen), that can display information (e.g., accountability indicators, first responder identification, alarm condition information) to the user and also receive input from the user. The user interface 304 may allow the user to acknowledge accountability indicators, enter identification information, forward alerts to other ESVs and/or first responders, adjust the luminosity of the display, interface with the RF sub-system 308 (e.g., change wireless settings, instruct to establish wireless interfaces), or the like. Optionally, the user interface 304 may include a keyboard, physical or capacitive buttons, or the like.

Figure 4:
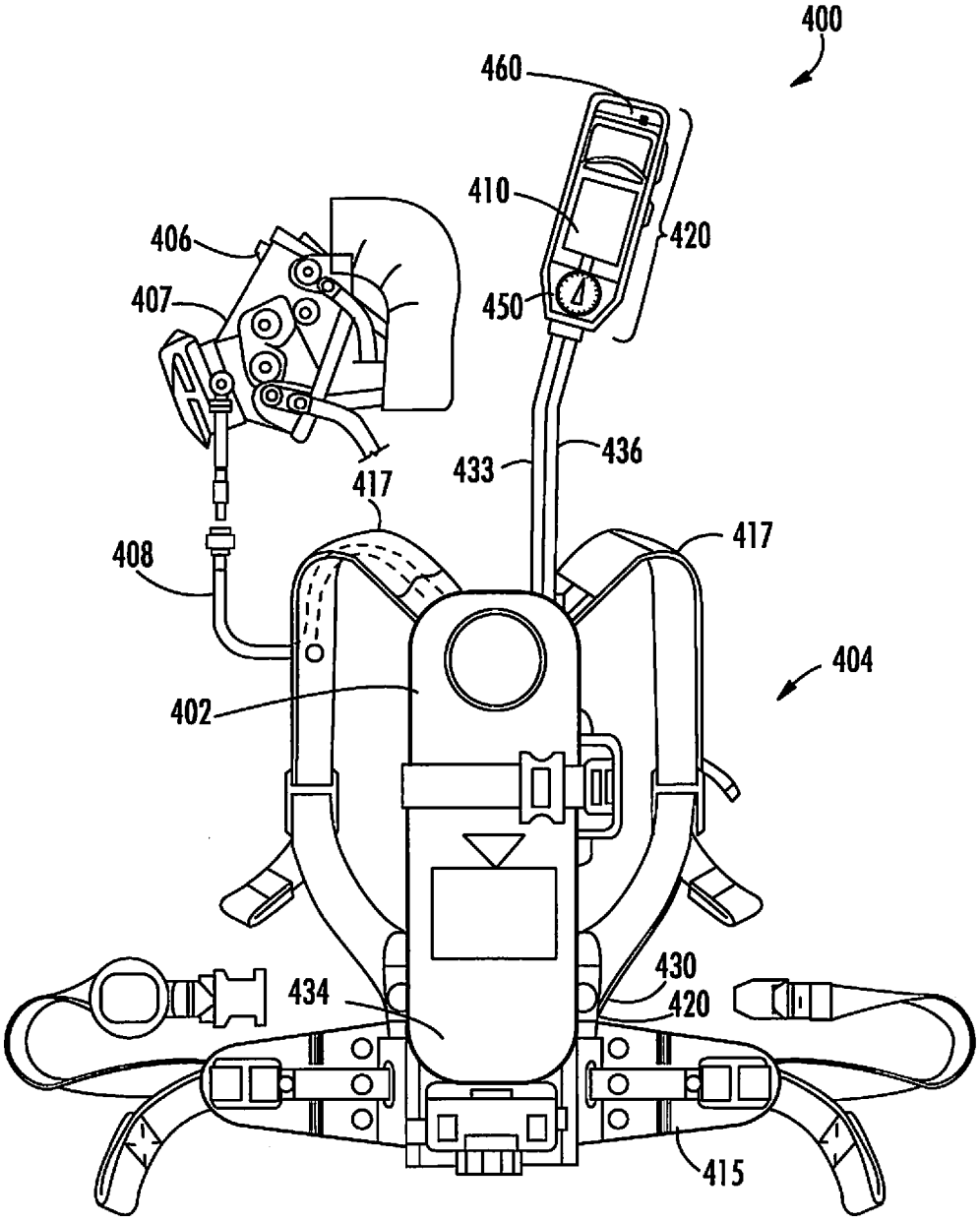
FIG. 4 illustrates a perspective view of a respiratory protection device, in accordance with an embodiment herein.

FIG. 4 is a perspective view of an exemplary respiratory protection device (e.g., Self-Contained Breathing Apparatus, Compressed Air Breathing Apparatus, Industrial breathing sets, Air-pack, or the like) 400 carried by first responders. As illustrated therein, the respiratory protection device (RPD) 400 may include a collection of first responder equipment, including a high-pressure air tank 402, mounted on a backpack 404, as well as headgear 406 that is worn on the user's head and connected to the air tank 402 by an air supply/data line 408. The line 408 supplies breathable air from the air tank 402 to the user's mouth and nose and power/data communications to a heads-up display 407. The backpack 404 includes a belt 415 and shoulder straps 417.

The RPD 400 includes a Personal Alert Safety System ("PASS") system 420, a personal digital assistant ("PDA") device 410, a video camera 460 and a "heads-up" display ("HUD") 407. The PASS system 420 may include both a PASS unit 430 and a separate PASS control console 450. The PASS unit 430 may be carried in a recess in the user's backpack 404, while the PASS control console 450 hangs from the end of a pressure data line 436, connected via a pressure reducer to the air tank 402, and a reinforced electronics cable sheath 433. The sheath 433 includes an electronics cable that interconnects the PASS unit 430 to the PASS control console 450 and PDA device 410. In the example of FIG. 4, the PASS system 420 is shown to be distributed at two locations within the RPD 400, namely at the end of pressure/data line 434 and at the base of the tank 402 on belt 415. Optionally, the PASS unit 430 and PASS control console 450 may be co-located within the RPD 400.

The HUD 407 is connected to the other electronic components via an electronics cable, which may be integral with the air supply/data line 408. However, the cable may also be separate from the air supply line 408. The HUD 407 displays various information, such as an indication of the amount of air remaining in the tank 402, instructions/information received from the accountability device 202, other first responders (e.g., on scene commander), and/or from other RPD 400, and the like. The air tank information may be gathered via a pressure transducer located in the outlet pathway of the tank 402. Optionally, the HUD 407 includes four LED's corresponding to the tank 402 being ¼ full, ½ full, ¾ full and completely full.

Figure 5:
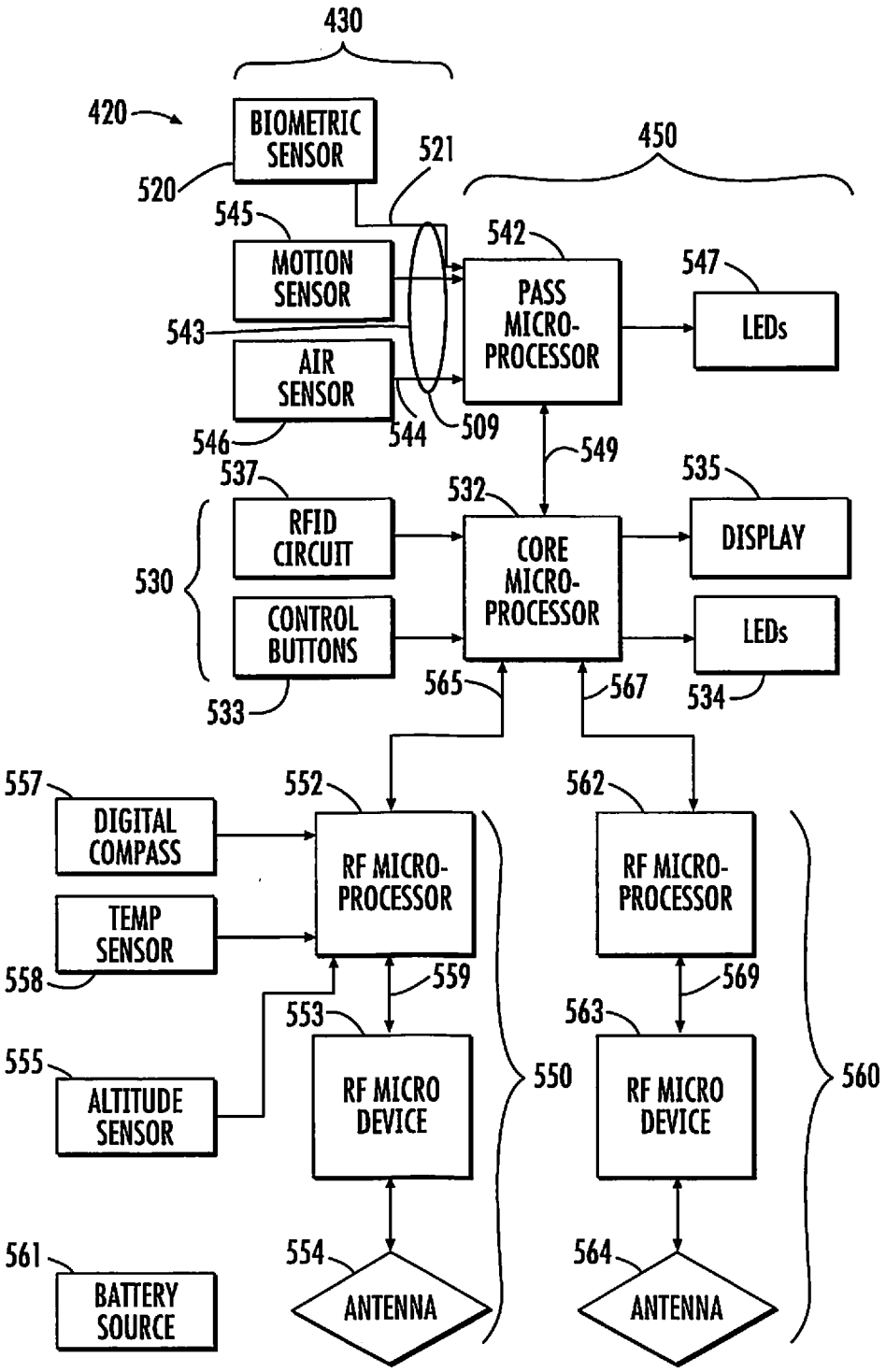
FIG. 5 illustrates a schematic diagram of a PASS system, in accordance with an embodiment herein.

FIG. 5 is a block diagram of the internal functionality of the PASS system 420. The PASS system 420 may include a master control section 530 (also referred to as a back-frame), the PASS control console 450, the PASS unit 430 and two wireless communication sections 550, 560. The control section 30 may be housed within the PDA device 410 or elsewhere. The control section 530 includes a master, core or console micro-processor 532, a plurality of user input mechanisms 533, such as push buttons, a plurality of user indicators 534, such as LED's, and a display 535.

A radio frequency identification (RFID) circuit 537 is connected to the micro-processor 532. The RF ID circuit 537 allows a user (e.g., first responder) of the PASS system 420 to log in and map the individual user's name or other identification information to a specific PASS system 420 and/or RPD 400. When used, the RFID circuit 537 reads a tag provided to the user. The tag contains personal information including the user's name, seat position, job responsibility and the like. At the beginning of each shift, the user's tag is read through the RFID circuit 537 by the PASS control console 450 (or by the PDA device 410. Optionally, the tag information for first responders at the emergency is stored on the memory 312 of the ESV 100 onto the identification database. The identification database may include the user's individual tag information, the user's name (e.g., John Smith), and/or a unique device ID corresponding to the PASS system 420 used by user.

The PASS control console 450 includes a micro-processor 542, inputs 521, 543, 544 and a plurality of user indicators 547, such as LED's. The inputs 521, 543, and 544 receive signals from a biometric sensor 521, a motion sensor 545, and an air sensor 546 in the PASS unit 430 over the communications bus 509. It should be noted, the micro-processor 542 may have more or less inputs than illustrated in FIG. 5. Likewise, in other embodiments the PASS unit 430 may have more (e.g., thermal sensor, proximity sensor) or less sensors than illustrated in FIG. 5. Optionally, the motion sensor 545 and air sensor 546 may be provided within the PASS control console 450. When the air sensor 546 is located at the PASS control console 450, an air pressure line is provided between the tank 402 and the PASS control console 450. The biometric sensor 521 measures the biological characteristics of the first responder, for example, blood pressure, body temperature, respiration, or the like. The micro-processor 542 of the PASS control console 450 is communicably connected with the micro-processor 532 of the control section 530 by a communications bus 549. The PASS system 420 is battery powered with replaceable or rechargeable batteries 561.

Each wireless communication section 550, 560, may include separate micro-processors 552, 562, RF micro devices 553, 563, and antennas 554, 564, respectively. In addition, the first wireless communication section 550 includes inputs from other devices, such as a digital compass 557, an altitude sensor 555, and a temperature sensor 558. The micro-processor 552 of the first wireless communication section 550 is communicably connected with the micro-processor 532 of the control section 530 by the communications bus 565, while the micro-processor 562 of the second wireless communication section 560 is communicably connected with the micro-processor 532 of the control section 530 by a communications bus 567. The wireless communication sections 550, 560 may utilize various wireless communication protocols such as WiFi, Bluetooth classic, Bluetooth Low Energy (BLE), WiGig, Wireless HD, Z-Wave, Zigbee, 802.11 and the like. At least one of the wireless communication sections 550, 560 may be utilizing the same wireless communication protocol of the RF subsystem 308.

It should be noted, that in other embodiments the functionality of the RF micro-processors 552 and 562 may be combined into a single micro-processor or software module operating on the core micro-processor 532. Optionally, the functionality of the RF micro-devices 553 and 563 may be combined into a single RF device that drives a single antenna or both of antennas 554 and 564. Optionally, the functionality of the RF micro devices 553 and 563 may be integrated into the RF micro-processor 552 and 562, respectively. Similarly, the RF micro-processors 552 and 562, and RF micro-devices 553 and 563 may all be combined into a common integrated component.

Data from the RPD 400, such as the remaining capacity of the air tank 402 measured by the air sensor 546, readings from the motion sensor 545 and/or biometric sensor 520 and the status of the PASS unit 430, is continually or regularly gathered by the PASS system 420 and relayed to the PASS control console 450 to the core micro-processor 532 via the first and/or second communications bus 559, 569. The core micro-processor 532 performs general functions such as analyzing received data, displaying received data or other information on the display 535, providing status or alarm indications to users via the LED's 534, and receiving user input or control instructions via the push buttons 533. In addition, the core micro-processor 532 formats/packetizes data, including data received from the PASS system 420, and provides the packetized data to the first and/or second wireless communication sections 550 and 560 via the communications buses 565 and 567 to be transmitted within a wireless network. When the first and/or second wireless micro-processors 552, 562 receive data from the micro-processor 532, the data is packaged into one or more data packets for transmission via the antenna 554, 564 through the RF micro device 553, 563. For example, the data may be packaged for a wireless network using a dual-mesh configuration as described in U.S. Patent Publication 2006/0125630, entitled "DUAL-MESH NETWORK AND COMMUNICATION SYSTEM FOR EMERGENCY SERVICES PERSONNEL," the entirety of each of which is incorporated herein by reference.

Figure 6:
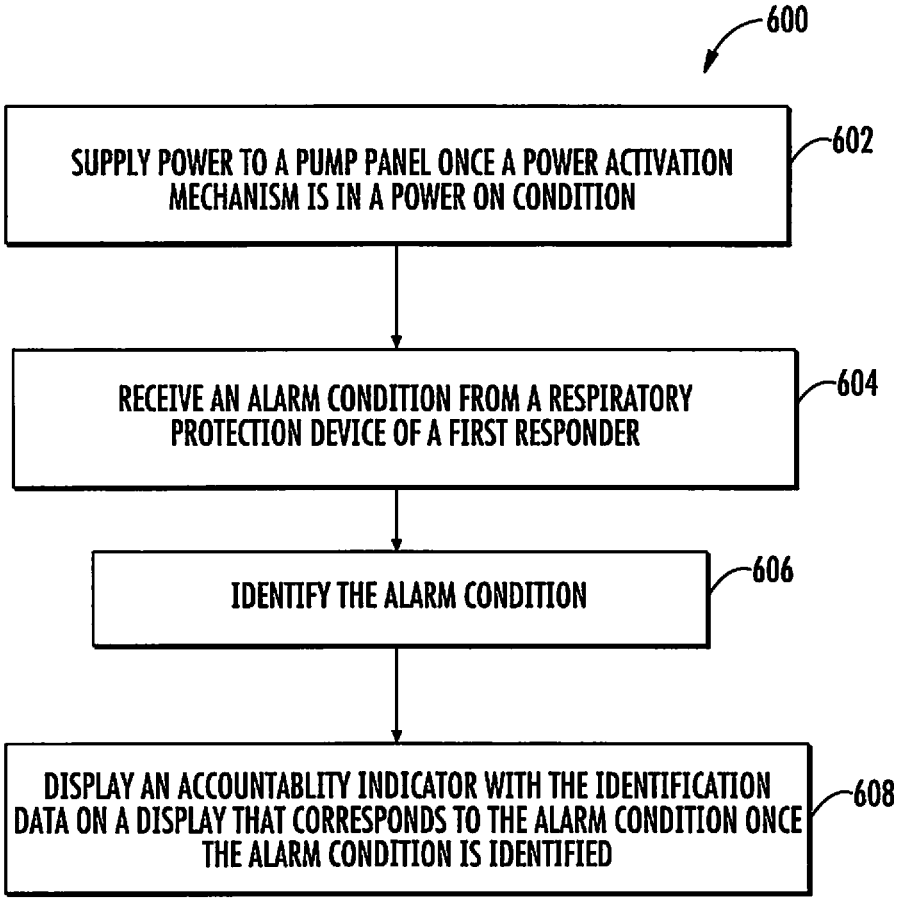
FIG. 6 illustrates a flow chart of signaling an alarm condition to a first responder from a pump panel, in accordance with an embodiment herein.

FIG. 6 illustrates flow chart of a method 600 for signaling an alarm condition to first responders from the pump panel 200. The method 600, for example, may employ structures or aspects of various embodiments (e.g., systems and/or methods) discussed herein (e.g., the pump panel 200, the accountability system 202, the EVS 100). In various embodiments, certain steps (or operations) may be omitted or added, certain steps may be combined, certain steps may be performed simultaneously, certain steps may be performed concurrently, certain steps may be split into multiple steps, certain steps may be performed in a different order, or certain steps or series of steps may be re-performed in an iterative fashion. It should be noted, other methods may be used, in accordance with an embodiment herein.

Beginning at 602, the method 600 supplies power to the pump panel 200 once the power activation mechanism 208 is in the power on condition.

At 604, the method 600 receives an alarm condition from the RPD 400 of the first responder. The RPD 400 may transmit the alarm condition from the RPD 400 due to low air pressure, a personal accountability report (PAR) check activation, an evacuation alarm, a low air state, a man down alarm, a respiratory failure, low blood pressure, or the like. The low air pressure and/or low air state may be determined by the PASS micro-processor 542 measuring an instantaneous or current air pressure and/or air volume of the air tank 402 and/or the air supply line 408 through the air sensor 546. The PASS micro-processor 542 may compare the current air pressure with a predetermined air pressure and/or air volume stored in an internal memory (e.g., ROM, RAM, Flash). If the current air pressure and/or air volume is below the predetermined threshold the PASS micro-processor 542 may output an alarm condition state to the core micro-processor 532 through the communication bus 549.

Optionally, the low blood pressure or respiratory failure may be determined by PASS micro-processor 542 measuring the breathing and blood pressure and/or blood flow of the first responder through the biometric sensor 520. For example, the PASS micro-processor 542 may compare the breathing rate and blood pressure and/or blood flow of the first responder with a previous measurement and/or predetermined breathing rate bandwidth and/or blood pressure in an internal memory (e.g., ROM, RAM, Flash). If the breathing rate and/or blood pressure is below the predetermined threshold and/or is greater than or less than the previous measurement by a set value the PASS micro-processor 542 may output an alarm condition state to the core micro-processor 532 through the communication bus 549.

Optionally, the core micro-processor 532 may receive the alarm condition from the first responder. For example, the first responder may input the alarm condition such as a man down alarm and/or evacuation alarm through the push buttons 533 or a user input mechanism of the PASS system 420.

Optionally, the core micro-processor 532 may determine the alarm condition based on the lack of respond from the first responder. For example, the PSS system 420 may receive a PAR check from the incident commander, a dispatch center, the ESV 100, or the like from at least one of the wireless communication sections 550 and 560 through the communication bus 565, 567. Additionally or alternatively, the PAR check may be activated by the PSS system 420 over a predetermined interval stored in the internal memory. The PAR check may be a request for a response or status of the first responder using, for example, the push buttons 533. If the first responder does not respond to the PAR check within the predetermined time the core micro-processor may determine the alarm condition state. Optionally, the core micro-processor may initiate the alarm condition once the PAR check is activated, and will exit the alarm condition state once the first responder responds to the PAR check.

Once the core micro-processor 532 enter and/or receives the alarm condition state the core micro-processor 532 may instruct at least one of the wireless communication sections 550, 560 to transmit or broadcast the alarm condition. Once transmitted, the alarm condition may be received by the RF sub-system 308 through the antenna 310.

Optionally, the alarm condition may be in the form of a data packet or a predetermined binary sequence that includes identification data corresponding to the RPD 400 (e.g., the RFID tag information, personal identification of the first responder). Additionally or alternatively, the alarm condition may include the cause of the alarm condition, for example, low air pressure, a personal accountability report (PAR) check activation, an evacuation alarm, a low air state, a man down alarm, a respiratory failure, low blood pressure, or the like. In some embodiments, the alarm condition may include data measure by the PASS system 420, for example, the amount of air pressure or air volume, the breathing and/or blood pressure of the first responder, or the like.

Returning to FIG. 6, at 606 the method 600 identifies the alarm condition. The controller 302 may receive the alarm condition from the RF sub-system 308 and identify the alarm condition. For example, the controller 302 may partition the alarm condition from the data packet based on a wireless protocol used by the PASS system 420 and RF sub-system 308. The controller 302 may compare the alarm condition received by the RF sub-system 308 with a syntax and/or protocol to confirm veracity of the alarm condition. If the alarm condition does not conform to the syntax and/or protocol the controller 302 may ignore the alarm condition.

Figure 7A:
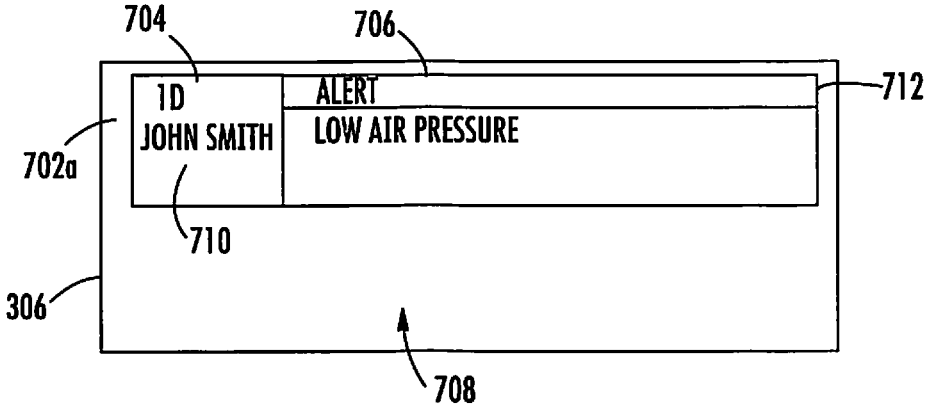
FIGS. 7*a-b* illustrate accountability indicators shown by a display of an accountability device.
Figure 7B:
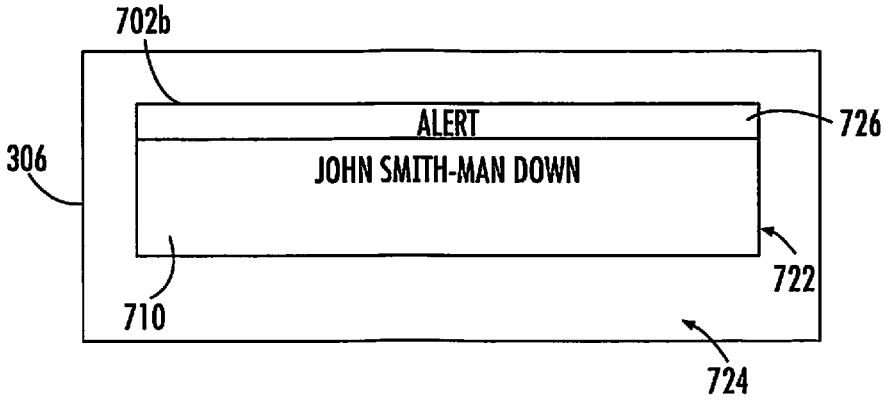

At 608, the method 600 displays an accountability indicator 702 with the identification data 710 on the display 306 that corresponds to the alarm condition once the alarm condition is identified. FIGS. 7*a-b* illustrate accountability indicators 702 shown on the display 306 of the accountability device 202.

FIG. 7*a* illustrates an accountability indicator 702*a* as an upper portion of the display 306 with indicator headers 704 and 706. A lower portion 708 of the display 306 may include graphical gauges (e.g., the gauges 214), user interface buttons or controls, or the like. For example, one of the user interface buttons or controls may include an acknowledgement signal. The acknowledgement signal may be transmitted from the RF sub-system 308 through the antenna 310 to the corresponding RPD 400 that transmitted the alert condition. Optionally, the user interface buttons or controls may include an alert signal in response to the alarm condition. The alert signal may include information about the alert condition and additional information (e.g., last position of the RPD 400). The alert signal may be transmitted from the RF sub-system 308 through the antenna 310 to another RPD 400, ESV 100, dispatch center, or the like.

FIG. 7*b* illustrates an accountability indicator 702*b* as a pop-up window 722 that is overlaid atop a background 724 of the display 306. The background may include graphical gauges (e.g., the gauges 214), user interface buttons or controls, or the like as described above.

Once the alarm condition is received or identified by the controller 302, the controller 302 may output the accountability indicator 702 to the display 306. The accountability indicator 702 includes the identification data 710 of the RPD 400 that transmitted the alarm condition. Optionally, the accountability indicator 702*a*, a top row 712 of the accountability indicator 702, a pop-up window banner 726, the background 724, the pop-up window 722, or the like may transition between different colors and/or intensities (e.g., brightness) to create flashes on the display 306 to alert the first responder proximate to the pump panel of the alert condition. Optionally, the controller 302 may reduce the intensity (e.g., brightness) or change the color of portions of the screen not corresponding to the accountability indicator 702 (e.g., the lower portion 708, the background 724).

It should be noted that the above-described arrangement of the accountability indicator 702 within the display 306 is only illustrative of the application of the principles of the present disclosure. Numerous modifications and alternative arrangements may be devised by those skilled in the art. Without departing from the spirit and scope of the present disclosure and the appended claims are intended to cover such modifications and arrangements. Thus, While the accountability indicator 702 has been shown in exemplary embodiments in the FIGS. 7*a-b* and described above with particularity and detail, it will be apparent to those of ordinary skill in the art that numerous modifications, including, but not limited to, variations in size, resolution, shape, color, form, position, animation and manner of operation may be made without departing from the principles and concepts set forth herein regarding the accountability indicator 702.

Additionally or alternatively, the controller 302 may transmit an audio alert, for example, to the speaker 206, corresponding with the accountability indicator 702 on the display 306.

While certain embodiments of the disclosure have been described herein, it is not intended that the disclosure be limited thereto, as it is intended that the disclosure be as broad in scope as the art will allow and that the specification be read likewise. Therefore, the above description should not be construed as limiting, but merely as exemplifications of particular embodiments. Those skilled in the art will envision other modifications within the scope and spirit of the claims appended hereto.

The control unit 102, the controller 302, the PASS micro-processor 542, the core micro-processor 532, and the RF micro-processors 552 and 562 may include any processor-based or microprocessor-based system including systems using microcontrollers, reduced instruction set computers (RISC), application specific integrated circuits (ASICs), field-programmable gate arrays (FPGAs), logic circuits, and any other circuit or processor capable of executing the functions described herein. Additionally or alternatively, the control unit 102, the controller 302, the PASS micro-processor 542, the core micro-processor 532, and the RF micro-processors 552 and 562 represent circuit modules that may be implemented as hardware with associated instructions (for example, software stored on a tangible and non-transitory computer readable storage medium, such as a computer hard drive, ROM, RAM, or the like) that perform the operations described herein. The above examples are exemplary only, and are thus not intended to limit in any way the definition and/or meaning of the term "controller." The control unit 102, the controller 302, the PASS micro-processor 542, the core micro-processor 532, and the RF micro-processors 552 and 562 may execute a set of instructions that are stored in one or more storage elements, in order to process data. The storage elements may also store data or other information as desired or needed. The storage element may be in the form of an information source or a physical memory element within the control unit 102, the controller 302, the PASS micro-processor 542, the core micro-processor 532, and the RF micro-processors 552 and 562. The set of instructions may include various commands that instruct the control unit 102, the controller 302, the PASS micro-processor 542, the core micro-processor 532, and the RF micro-processors 552 and 562 to perform specific operations such as the methods and processes of the various embodiments of the subject matter described herein. The set of instructions may be in the form of a software program. The software may be in various forms such as system software or application software. Further, the software may be in the form of a collection of separate programs or modules, a program module within a larger program or a portion of a program module. The software also may include modular programming in the form of object-oriented programming. The processing of input data by the processing machine may be in response to user commands, or in response to results of previous processing, or in response to a request made by another processing machine.

It is to be understood that the subject matter described herein is not limited in its application to the details of construction and the arrangement of components set forth in the description herein or illustrated in the drawings hereof. The subject matter described herein is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. While the dimensions, types of materials and coatings described herein are intended to define the parameters of the invention, they are by no means limiting and are exemplary embodiments. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112(f), unless and until such claim limitations expressly use the phrase "means for" followed by a statement of function void of further structure.

While certain embodiments of the disclosure have been described herein, it is not intended that the disclosure be limited thereto, as it is intended that the disclosure be as broad in scope as the art will allow and that the specification be read likewise. Therefore, the above description should not be construed as limiting, but merely as exemplifications of particular embodiments. Those skilled in the art will envision other modifications within the scope and spirit of the claims appended hereto.

What is claimed is:

1. An accountability system for signaling an alarm condition to first responders, comprising:

a display embedded within a pump panel, wherein the panel includes at least one gauge and at least one valve indicator;

a radio frequency (RF) sub-system, wherein the RF sub-system is configured to receive transmissions from a respiratory protection device (RPD), the transmission including an alarm condition; and a controller coupled to the display and the RF sub-system, wherein the controller is configured to instruct the display to display an accountability indicator once the alarm condition is received by the RF sub-system.

2. The accountability system of claim 1, wherein the RF sub-system further configured to transmit data to the RPD.

3. The accountability system of claim 1, wherein the pump panel includes a power activation mechanism for selectively supplying power to the pump panel control, the power activation mechanism having at least a power on condition and power off condition.

4. The accountability system of claim 1, wherein the alarm condition is due to at least one of a group consisting of a low air pressure, a PAR check activation, an evacuate alarm, a low air alarm, a man down alarm, a respiratory failure, or a low blood pressure.

5. The accountability system of claim 1, wherein the RF sub-system transmits at least one of an acknowledgement signal or alert signal in response to the alarm condition.

6. The accountability system of claim 1, wherein one or more gauges of the pump panel are displayed on the display.

7. The accountability system of claim 1, wherein the pump panel is affixed to a platform.

8. The accountability system of claim 1, wherein the pump panel is on a portion of an exterior of a fire truck.

9. The accountability system of claim 1, wherein the accountability indicator on the display are selected from a group consisting of a flashing indicator or pop-up window.

10. The accountability system of claim 1, wherein the controller is further configured to instruct a speaker of the pump panel to transmit an audio signal with the accountability indicator.

11. The accountability system of claim 1, wherein the display is a touch sensitive display screen.

12. A method for signaling an alarm condition to first responders from a pump panel, the method comprising:

supplying power to a pump panel once a power activation mechanism is in a power on condition;

receiving an alarm condition from a respiratory protection device (RPD) of a first responder, wherein the alarm condition includes identification data corresponding to the RPD;

identifying the alarm condition;

displaying an accountability indicator with the identification data on a display that corresponds to the alarm condition once the alarm condition is identified, wherein the display is embedded within the pump panel of an emergency service vehicle.

13. The method of claim 12, wherein the emergency service vehicle is a fire truck.

14. The method of claim 12, wherein the identifying operation of the alarm condition further identifies that the alarm condition is due to at least one of a group consisting of a low air pressure, a PAR check activation, an evacuate alarm, a low air alarm, a man down alarm, a respiratory failure, or a low blood pressure.

15. The method of claim 12, further comprising displaying a gauge in a graphical manner that corresponds to a water pressure of a valve on the pump panel.

16. The method of claim 12, wherein the pump panel is affixed to a platform.

17. The method of claim 12, further comprising transmitting at least one of an acknowledgement signal or alert signal in response to the alarm condition.

18. The method of claim 12, further comprising emitting an audio alert from a speaker on the pump panel.

19. The method of claim 12, wherein the accountability indicator on the display is at least one of from a group consisting of a flashing indicator or pop-up window.

20. A pump panel for an emergency service vehicle, comprising:

a platform affixed to an emergency service vehicle;

a power activation mechanism configured to supply power when in a power on condition;

one or more gauges, wherein the gauges measure a water pressure to a corresponding valve indicator;

a display;

an RF-subsystem configured to receive transmissions from a respiratory protection device (RPD), wherein the transmissions include an alarm condition;

a controller configured to identify when an alarm condition is received by the RF sub-system, the controller instructs the display to display an accountability indicator when the alarm condition is identified.

* * * * *